United States Patent [19]

Flemming

[11] Patent Number: 4,920,663

[45] Date of Patent: May 1, 1990

[54] ATHLETIC SHOE, PARTICULARLY A TENNIS SHOE, AND PROCESS FOR PRODUCING SUCH A SHOE

[75] Inventor: Udo Flemming, Erlangen, Fed. Rep. of Germany

[73] Assignee: PUMA Aktiengesellschaft Rudolf Dassler Sport, Herzogenaurach, Fed. Rep. of Germany

[21] Appl. No.: 368,706

[22] Filed: Jun. 20, 1989

[30] Foreign Application Priority Data

Jun. 20, 1988 [DE] Fed. Rep. of Germany ..... 3820787

[51] Int. Cl.[5] ..... A43B 13/24

[52] U.S. Cl. ..... 36/73; 36/75 R; 36/25 R; 36/134

[58] Field of Search ..... 36/134, 35 R, 25 R, 36/73, 75 R; 12/146 BR

[56] References Cited

U.S. PATENT DOCUMENTS 4,134,220 1/1979 Dassler .

FOREIGN PATENT DOCUMENTS 2312198 9/1974 Fed. Rep. of Germany .
2635474 2/1978 Fed. Rep. of Germany .
3233900 3/1984 Fed. Rep. of Germany .
3541897 1/1987 Fed. Rep. of Germany ..... 36/134

*Primary Examiner*—Paul T. Sewell
*Assistant Examiner*—Andrew D. Meyers
*Attorney, Agent, or Firm*—Sixbey, Friedman, Leedom & Ferguson

[57] ABSTRACT

An athletic shoe, particularly a tennis shoe, with wear-resistant parts provided in the area of the outsole to increase the wear resistance of the sole material. The wear resistance of the outsole, particularly in the toe area or in other peripheral areas of the outsole, is significantly increased and yet a sufficient braking effect is maintained by the material of the outsole or of the edge of the outsole. This is achieved by molding parts made of one of such materials as an oxide ceramic, metal carbide, metal nitride or hard metal into the outsole in an upwardly directed edge (3) of toe area (4) of outsole (2) or by subsequently inserting them into the outsole in such a way that the outer surface of the parts ends approximately flush with an outer side of the edge surface of outsole.

21 Claims, 1 Drawing Sheet

ATHLETIC SHOE, PARTICULARLY A TENNIS SHOE, AND PROCESS FOR PRODUCING SUCH A SHOE

BACKGROUND OF THE INVENTION

This invention relates to an athletic shoe, particularly a tennis shoe and to a process to produce such an athletic shoe, with wear-resistant parts provided in the area of the outsole to increase the wear resistance of the sole material. From German Auslegeschrift No. 23 12 198, a sole for an athletic shoe, particularly a tennis shoe, is known, for use on plastic indoor floors, in which a textile fabric is placed in a rubber sole so that the fabric spaces of the textile fabric are filled out by the rubber and a part of the textile fabric is exposed on the tread surface. The textile fabric can extend up over the sole edges on all sides and can also cover the upper surface of the toe cap. The disadvantage in this solution is that the hard fibers of the textile fabric which are treated with synthetic resin fray and finally tear off at high degrees of wear and/or high temperature stress. Thus the original high resistance to wear is brought to an end.

Furthermore, from German Offenlegungsschrift No. 26 35 474 and its corresponding U.S. Pat. No. 4,134,220, an athletic shoe, particularly a tennis shoe, is known in which in a sole made of pliable plastic, is covered at least in the area of the toe tip, by a layer of wear-resistant material that is different from the material of the sole. In particular, a layer of chrome leather is placed at least in the edge area, approximately perpendicular to the tread surface. This so-called "chrome leather sole" has been used especially for tennis shoes on plastic courts with tartan, carpeted or asphalt floors or coverings. The disadvantage of athletic shoes with such outsoles is that on floor coverings with relatively good sliding properties, for example on floors made of plastic materials with a relatively smooth surface, the limited sliding capacity, which is desirable in itself, i.e. the possible sliding of the athlete wearing such shoes by several centimeters, turns out to be too great, so that this athletic shoe, particularly tennis shoe, cannot be used as an allround shoe. The preferred area of use of this indoor tennis shoe is consequently, especially, indoor tennis courts with carpeted floors. Also these soles lead to increased wear, as soon as the openings which penetrate the chrome leather insert, which are filled with the plastic material of the outsole, constitute too high a proportion in terms of the surface.

From German Offenlegungsschrift No. 32 33 900 it is known how to design sport shoe soles with gripping elements, for example with cleats, spikes or baseball fittings, to be extremely wear-resistant, in that the gripping elements consist wholly or partially of oxide ceramics. In this solution, it is a matter of producing the gripping elements, which protrude far out from the outsole, of oxide ceramics, as much as possible, to exclude damage to these gripping elements and also to reduce to a minimum the danger of injury because of sharp edges, ridges or the like.

SUMMARY OF THE INVENTION

The primary object of the present invention is to design the outsole of an athletic shoe, particularly a tennis shoe, to be used on floors which cause much wear and tear in such a way that the wear resistance of the outsole is increased, particularly in the area of the tow and/or in other peripheral areas of the outsole and/or in other areas bordering on the tread or ground contact surface of the outsole, preferably in the sole edge pointing upward or angled toward the show upper, and yet a sufficient braking effect is maintained by the material of the outsole or the edge of the outsole.

This object is attained by a preferred embodiment of the invention incoroporating oxide ceramic parts into the outsole in such a way that the outer surface of these parts lie flush with the outer surface of an edge area of the outsole.

With the invention, the advantage is achieved in particular that in sliding on edge areas of the outsole on floors causing much wear and tear, the wear-resistant parts in the edge area of the outsole sufficiently support this area, so that the sole material in the corresponding edge areas of the outsole is protected, i.e., the main stress in these edge areas of the outsole is absorbed by the wear-resistant parts.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENTS

Figure 1:
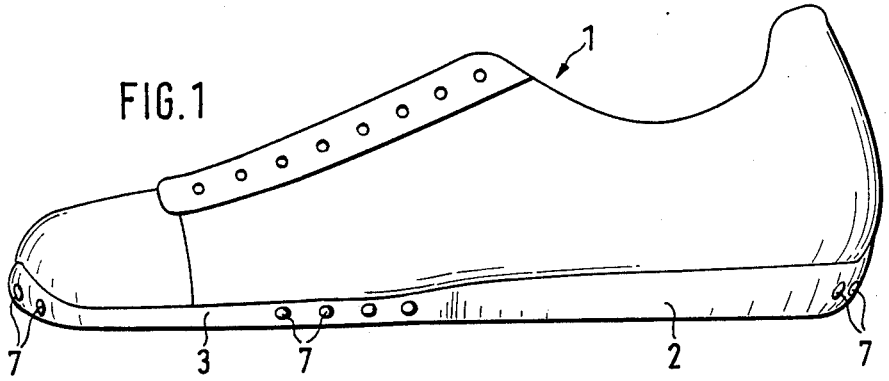
FIG. 1 shows an athletic shoe with an outsole according to the invention in a side elevation view of the medial (inner) side of the shoe.

FIG. 1 shows an athletic shoe that is designated 1, and which has an outsole 2, which is usually connected with the shoe upper by a shock absorbing midsole (which is not represented in the drawing). Edge 3 of outsole 2 extends upwardly, at least in toe area 4, as known in the art, to form a shell within which a midsole can be applied. Advantageously, edge 3 of outsole 2 also extends upwardly in heel area 5 and at medial (inner) ball area 6 as well as, optionally, also in lateral (outer) ball area 10 (see FIG. 2). In the embodiment according to FIG. 2, edge 3 of outsole 2 extends upwardly on all sides, i.e., all-around outsole 2. Outsole 2 and edge 3 need not, initially, be formed as a structural unit, but can be produced as individual parts that are subsequently joined together. For example, edge 3 can, optionally, be designed in the form of edge bands.

Figure 3:
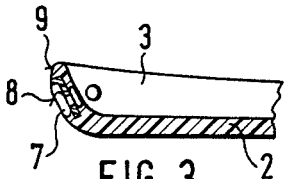
FIG. 3 is a longitudinal sectional view through the forefoot area of the sole of the FIG. 1 shoe.
Figure 4:
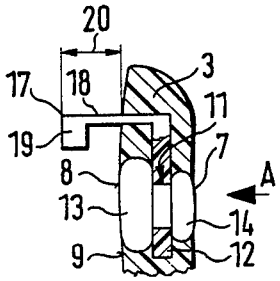
FIG. 4 is an enlarged section of a portion of the sole that has been cut away to show details of a wear-resistant part mounted on a support, seen from the side.

According to the invention, at least in upwardly extending edge 3 of toe area 4, wear-resistant parts 7 supported in thin plates, are incorporated or molded into the outsole 2, as made appropriately clear by FIGS. 3 and 4. In this case, the outer surface 8 of wear-resistant parts 7 ends flush with the surface 9 of edge 3 of outsole 2. Depending on the hardness of the edge material, surface 8 of wear-resistant parts 7 can also protrude somewhat beyond edge surface 9 or may be placed slightly recessed into it.

Figure 2:
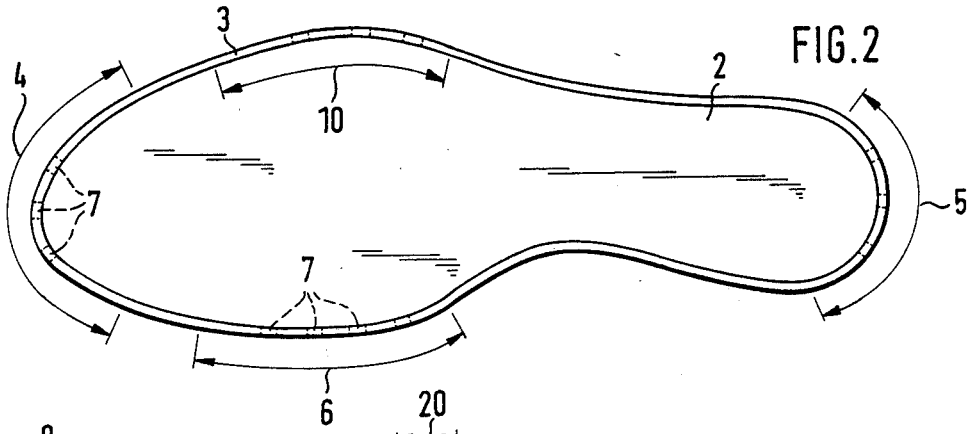
FIG. 2 is a bottom plan view of the outsole of the FIG. 1 shoe.

In FIG. 2, wear-resistant parts 7 are provided in toe area 4, heel area 5, medial ball area 6 and lateral ball area 10. These are all areas which, especially in playing tennis or other kinds of indoor sports, such as indoor handball, must have sliding properties so that foot injuries, e.g., ligament strains or the like caused by too abrupt a stopping of the outsole of the shoe on high traction floor coverings, can often be prevented.

The comparatively soft material of edge 3 of outsole 2 often has relatively good anti-slip properties in many ways and is, therefore, exposed to greater wear, as a rule. In contrast with it, wear-resistant parts 7 have significantly better sliding properties and a very great wear resistance.

As the material for wear-resistant parts 7, especially suitable are oxide ceramics, such as aluminum oxide or one or more metal compounds such as metal carbides, for example SiC and/or TiC, and/or NiC etc., or even metal nitrides, such as SiN and/or TiN, and/or WoN etc. Also, hard metals known in the art are suitable for this purpose.

Resistant parts 7 advantageously have the shape of thin plates or disks and have an annular neck 11 by which they are held in place in the material of edge 3 of outsole 2, either directly or, preferably, by means of a support 12. In the latter case, support 12 is molded into the edge material. Support 12 is thinner, in particular significantly thinner, than the thickness of wear-resistant parts 7. In particular, its thickness corresponds to the thickness of annular neck 11 of wear-resistant part 7.

Figure 5:
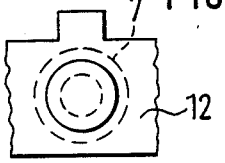
FIG. 5 is a view of the wear-resistant part and support of FIG. 4 seen in the direction of arrow A.
Figure 6:
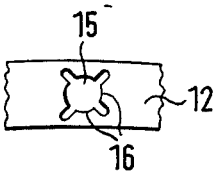
FIG. 6 is an elevational view of a section of a support without a wear-resistant part mounted therein.

FIGS. 4 and 5 show a wear-resistant part 7 in disk form with an annular neck 11 designed so as to create a circular groove within which securing material of edges 3 or, as shown, support 12 can engage. The thickness of wear-resistant part 7 in this case corresponds, in essence, to the thickness of edge 3 of outsole 2 at the point of incorporation of part 7. A front disk segment 13 and back disk segment 14 are formed and separated by neck 11. Advantageously, the diameter of front disk segment 13 is greater than that of back disk segment 14. Support 12 is made of a plastic, such as polyethylene, polyurethane, polyvinyl chloride, polyester, polyether, rubber or the like, and wear-resistant parts 7 can be incorporated into support 12 when it is molded or they can be buttoned into openings 15 of support 12 (FIG. 6). In the latter case, the support 12 can also be made of leather, or in some circumstances even metal, particularly aluminum. For good support and easy assembly of wear-resistant parts 7, opening 15 has several inward protruding lugs 16 which can engage neck 11 of wear-resistant parts 7.

Supports 12, fitted with wear-resistant parts 7, are laid into a mold and encapsulated during injection molding and/or casting of the sole or edge material of outsole 2. To hold support 12 precisely positioned in a preferably two-piece mold, at least two arranging elements 17 are molded on to it. In the case of a support 12 having greater lengthwise measurements than that shown in FIG. 7, correspondingly more adjustment elements 17 are provided.

Figure 7:
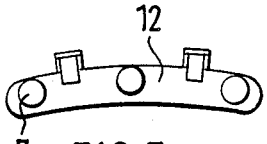
FIG. 7 shows a support with wear-resistant parts mounted in it to be inserted into an injection mold and/or a casting mold.

Arranging elements 17, in the embodiment according to FIGS. 4 and 7, are hook-like and consist of a lug 18 that projects at a right angle from strip-shaped support 12, on which a downwardly jutting stud 19 is provided. The latter is inserted into corresponding openings of an injection mold or casting mold, so that the position of support 12 and wear-resistant parts 7 in the casting mold is precisely set. After the molding process of outsole 2 or of an edge strip or ring forming edge 3, protruding parts 20 of arranging elements 17 are cut off. For this purpose, predetermined breaking points can be provided in support 12.

Of course wear-resistant parts 7 can also be fastened in support 12 in a way other than described. In particular it is possible to provide wear-resistant parts 7 with perforations such as that illustrated by broken lines in FIG. 8 and designated 18, so that, along with an annular locking in position by support 12 (corresponding to FIG. 4) a penetrating axial locking in position by the sole material is also possible. This can be done by producing wear-resistant parts 7 generally via powder metallurgy techniques utilizing a suitable powder, which is treated with appropriate solvents. In principle, this powder-solvent compound can be injection molded, so that corresponding holelike through channels or blind hole-like channels can be provided in the wear-resistant parts 7. Thus, annular recesses can be provided in these wear-resistant parts 7 which lead to increased adhesion with the actual outsole.

Figure 8:
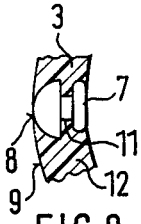
FIG. 8 is a cutaway of the edge of a sole with a wear-resistant part designed in the shape of a mushroom.

Wear-resistant parts 7 can be designed with mushroom-shaped outer sides, to reduce the contact surface, if the corresponding athletic shoe is to be used on surfaces, on which overly-high sliding properties are not desired (see FIG. 8).

By using the invention, athletic shoes with such outsoles are suitable for the widest range of uses, namely for floors made of synthetic materials of every kind, needle felt coverings, other types of carpeted floors, synthetic grass, concrete, asphalt and other types of floor coverings with high and very high wear values.

To improve the bonding of support 12, for wear-resistant parts 7, with sole 2, a treatment with a chloride-based primer can be provided. In addition, this support 12 can be treated with adhesive or roughened to ensure an intensive bonding with the corresponding parts of the outsole. Likewise, similar treatments may be applied to the parts 7, as well.

More than the three wear-resistant parts 7 shown in FIG. 7 can also be provided in support 12, so that the increased wear resistance is found not only in the toe area of outsole 2, but also can extend far into medial ball or lateral ball areas 6, 10 (note, four parts 7 are shown in medial ball area 6 in FIGS. 1 and 2). Also, these parts 7, optionally, can be be arranged so as to be offset in several rows over one another and/or alternately facing one another, for example in zigzag form or the like.

It is important that the wear-resistant parts that are used, as known in the prior art, have an almost unlimited wear resistance, so that higher wear values of outsole 2, either because of mechanical or heat stresses, need not be feared.

Optionally, it can be useful to place wear-resistant parts 7 at comparatively great distances of one to two centimeters, so that excessively high sliding values can be eliminated on floor coverings with relatively good sliding properties and an otherwise excessive sliding effect or "skating effect," which could be feared, can be eliminated with certainty.

Even if the preferred area of use for the present invention of athletic shoes, particularly tennis shoes, is for indoor floors, these athletic shoe types can also be used advantageously for outdoor sports on rough floors or floor coverings of any kind. Even for lawn floors with artificial grass, use appears to be advantageous.

Even if the outsole, or at least a part of the outsole particularly the toe area of the outsole, is preferably designed without a tread profile, the use of highly wear-resistant parts 7 is not limited to outsoles without tread profiles, particularly if these parts 7 are placed exclusively in upward directed edge area 3 of outsole 2. This edge area 3 can be designed without any profiling even in outsoles with tread profiles.

Basically, it is also possible, preferably in outsoles without tread profile, to install highly wear-resistant parts 7, additionally, in the toe or inner ball area and, optionally, also in the heel area of the actual ground contact surface of outsole 2.

As already suggested, between outsole 2 and the shoe upper, a shock-absorbing midsole can be installed, particularly one made of foam materials of suitable consistency, such as foamed polyurethane.

While I have shown and described various embodiments in accordance with the present invention, it is understood that the safe is not limited thereto, but is susceptible of numerous changes and modifications as known to those skilled in the art, and I, therefore, do not wish to be limited to the details shown and described herein, but intend to cover all such changes and modifications as are encompassed by the scope of the appended claims.

I claim:

1. An athletic shoe with wear-resistant parts provided in an area of an outsole to increase the wear resistance of the sole, wherein the wear-resistant parts are made of a material selected from the group consisting of oxide ceramics, metal carbides and metal nitrides, and are embedded into the outsole in an upwardly directed edge in at least a toe area of the outsole in such a way that an outer surface of the wear-resistant parts ends approximately flush with an outer surface of the edge of the outsole.

2. An athletic shoe according to claim 1, wherein the upwardly directed edge is molded about the wear-resistant parts.

3. An athletic shoe according to claim 1, wherein wear-resistant parts are also provided in the edge of the outsole in an inner ball area.

4. An athletic shoe according to claim 3, wherein wear-resistant parts are also provided in the edge of the outsole in a heel area.

5. An athletic shoe according to claim 4, wherein wear-resistant parts are also provided in the edge of the outsole in an outer ball area.

6. An athletic shoe according to claim 1, wherein wear-resistant parts are also provided in the edge of the outsole in a heel area.

7. An athletic shoe according to claim 1, wherein wear-resistant parts are also provided in the edge of the outsole in an outer ball area.

8. An athletic shoe according to claim 1, wherein the wear-resistant parts are fastened to a support that is embedded into the outsole.

9. An athletic shoe according to claim 1, wherein the wear-resistant parts are approximately as thick as the edge of the outsole.

10. An athletic shoe according to claim 1, wherein the wear-resistant parts are disk-shaped.

11. An athletic shoe according to claim 10, wherein disk-shaped parts have a recessed neck.

12. An athletic shoe according to claim 11, wherein the disk-shaped parts have front disk and back disk segments, the front disk segment having a greater diameter than the back disk segment.

13. An athletic shoe according to claim 8, wherein the wear-resistant parts are buttoned into the support.

14. An athletic shoe according to claim 13, wherein the support has openings, for insertion of the wear-resistant parts, which have a plurality of inwardly protruding lugs which engage a neck of the wear-resistant parts.

15. An athletic shoe according to claim 8, wherein the support is provided with at least two arranging elements for positioning the support in a mold for producing at least the edge of the outsole.

16. An athletic shoe according to claim 15, wherein parts of the arrangement elements protrude from the edge of the outsole and are removable for finishing of the outsole.

17. An athletic shoe according to claim 1, wherein wear-resistant parts are provided with at least one of a roughened surface, a fissured surface and a perforation for facilitating securement thereof within the outsole.

18. An athletic shoe according to claim 1, wherein the wear-resistant parts are provided with at least one hole, which is penetrated by material of the outsole.

19. Process for producing a sole for an athletic shoe wherein wear-resistant parts are engaged within a strip-shaped support provided with arranging elements which are thinner than the wear-resistant parts, wherein the support with arranging elements is then inserted into recesses of an at least two-part mold after which the mold is closed and at least an edge of an outsole is produced by at least one of an injection molding and a casting process, and wherein the mold is opened, the edge of the outsole removed from the mold and protruding parts of the arranging elements then cut off.

20. Process according to claim 19, wherein the wear-resistant parts are treated with a chloride-based primer before molding.

21. Process according to claim 19, wherein the wear-resistant parts are treated with an adhesive before molding.

* * * * *